US009115717B2

(12) United States Patent
Gaertner et al.

(10) Patent No.: US 9,115,717 B2
(45) Date of Patent: Aug. 25, 2015

(54) AXIAL DISC AND GEAR PUMP WITH AXIAL DISC

(75) Inventors: Oliver Gaertner, Abstatt (DE); Rene Schepp, Waiblingen (DE); Andreas Klein, Dresden (DE); Benjamin Scheibitz, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 46 days.

(21) Appl. No.: 13/996,991

(22) PCT Filed: Nov. 30, 2011

(86) PCT No.: PCT/EP2011/071395

§ 371 (c)(1),
(2), (4) Date: Sep. 12, 2013

(87) PCT Pub. No.: WO2012/084437

PCT Pub. Date: Jun. 28, 2012

(65) Prior Publication Data

US 2014/0010696 A1 Jan. 9, 2014

(30) Foreign Application Priority Data

Dec. 23, 2010 (DE) ..... 10 2010 064 130

(51) Int. Cl.

| | |
|---|---|
| ***F03C 2/00*** | (2006.01) |
| ***F03C 4/00*** | (2006.01) |
| ***F04C 2/00*** | (2006.01) |
| ***F04C 27/00*** | (2006.01) |
| ***F01C 1/10*** | (2006.01) |
| ***F04C 15/00*** | (2006.01) |

(Continued)

(52) U.S. Cl.

CPC ..... *F04C 27/006* (2013.01); *F01C 1/102* (2013.01); *F01C 21/108* (2013.01); *F04C 2/101* (2013.01); *F04C 15/0023* (2013.01); *F04C 15/0026* (2013.01); *F04C 2230/91* (2013.01); *F04C 2230/92* (2013.01)

(58) Field of Classification Search

USPC ..... 418/71, 126–129, 170, 178–179, 166, 418/171, 131–132

See application file for complete search history.

(56) References Cited

U.S. PATENT DOCUMENTS

| | | | | |
|---|---|---|---|---|
| 4,132,515 | A * | 1/1979 | Kruger | 418/170 |
| 6,293,777 | B1 * | 9/2001 | Unsold | 418/132 |

(Continued)

FOREIGN PATENT DOCUMENTS

| | | |
|---|---|---|
| DE | 1 528 947 | 9/1969 |
| DE | 1 528 946 | 10/1969 |

(Continued)

OTHER PUBLICATIONS

International Search Report corresponding to PCT Application No. PCT/EP2011/071395, mailed Apr. 17, 2013 (German and English language document) (7 pages).

*Primary Examiner* — Theresa Trieu

(74) *Attorney, Agent, or Firm* — Maginot, Moore & Beck LLP

(57) ABSTRACT

An internal gear pump for a hydraulic vehicle brake system has axial discs which, by the exertion of pressure on the outer sides thereof, are pressed against gearwheels of the internal gear pump for lateral sealing, provided on the inner sides thereof with grooves through which the gearwheels convey brake fluid as they are driven in rotation, which brake fluid thereby passes, for lubrication, between the axial discs and the gearwheels of the internal gear pump.

6 Claims, 3 Drawing Sheets

(51) Int. Cl.
*F01C 21/10* (2006.01)
*F04C 2/10* (2006.01)

(56) References Cited

U.S. PATENT DOCUMENTS

| | | | | |
|---|---|---|---|---|
| 6,450,792 | B1 * | 9/2002 | Eisenbacher et al. | 418/170 |
| 6,905,321 | B2 * | 6/2005 | Uchiyama et al. | 418/132 |

FOREIGN PATENT DOCUMENTS

| | | | |
|---|---|---|---|
| DE | 1 553 193 | | 1/1971 |
| DE | 196 13 833 | A1 | 10/1997 |
| DE | 10 2008 054 767 | A1 | 6/2010 |
| JP | 57-91391 | A | 6/1982 |
| JP | 59-168589 | U | 11/1984 |
| JP | 2009-144689 | A | 7/2009 |
| JP | 2010-159724 | A | 7/2010 |

* cited by examiner

AXIAL DISC AND GEAR PUMP WITH AXIAL DISC

This application is a 35 U.S.C. §371 National Stage Application of PCT/EP2011/071395, filed on Nov. 30, 2011, which claims the benefit of priority to Serial No. DE 10 2010 064 130.8, filed on Dec. 23, 2010 in Germany, the disclosures of which are incorporated herein by reference in their entirety.

The disclosure concerns an axial disc for a gear pump with the features described herein, in particular for an internal gear pump, and a gear pump with such an axial disc.

BACKGROUND

The disclosure is explained below with reference to an internal gear pump, but in principle it can be applied also to gear pumps in general, i.e. also to external gear pumps. Internal gear pumps have an externally toothed gearwheel which, for unambiguous designation, is referred to below as the pinion, and an internally geared so-called crown wheel, wherein the pinion is arranged eccentrically in the crown wheel so that the two gearwheels, i.e. the pinion and the crown wheel, can intermesh together in a peripheral portion. On another peripheral portion there is a sickle-shaped clearance between the two gearwheels, which is delimited on the inside by the pinion and on the outside by the crown wheel. The clearance is also called the pump chamber or compression chamber. Due to the rotational drive of the two gearwheels, wherein usually the pinion is held rotationally fixed on a pump shaft which is driven in rotation, and via the pinion the crown wheel is also driven rotationally, fluid is conveyed from a suction region to a pressure region of the pump chamber located behind this in the direction of rotation of the gearwheels. A pump inlet opens in the suction region and a pump outlet branches from the pressure region.

At the side i.e. on the faces of the gearwheels, side walls delimit the pump chamber. The side walls can also be called the end walls, covers or similar. An example of such an internal gear pump is disclosed in patent DE 196 13 833 B4. To seal the pump chamber at the faces of the gearwheels, the known internal gear pump has discs known as axial discs which are rotationally fixed and lie against the gearwheels with their insides facing the gearwheels. On the outsides of the axial discs, pressure fields are provided which are pressurized with fluid from the pressure region of the internal gear pump. The pressure fields are flat depressions which extend in a sickle shape over approximately the pump chamber or part of the pump chamber. The pressure fields can be formed in the outsides of the axial discs and/or in the insides facing these of the side walls of the internal gear pump. The axial discs are held rotationally fixed. The pressure of the fluid conveyed presses the axial discs against the faces of the gearwheels of the internal gear pump in order to seal the pump chamber. This does not achieve a hermetic seal but a good compromise between low leakage, good lubrication and low friction between the rotating gearwheels and the fixed axial disc, and low wear.

Lubrication between the faces of the gearwheels of the internal gear pump and the axial discs lying thereon and pressurized from the outside is provided in the manner of hydrodynamic lubrication by fluid which adheres to the faces of the gearwheels and is conveyed by the gearwheels between the axial discs and the faces of the gearwheels.

SUMMARY

The axial disc according to the disclosure has, on its inside, a surface structure which, in cooperation with the gearwheels rotating on operation of the gear pump, ensures that fluid conveyed by the gear pump passes between the faces of the gearwheels and the axial disc lying thereon. The inside of the axial disc is the side which faces the gearwheel of the gear pump and lies against the face of the gearwheel. The disclosed axial disc improves lubrication between the fixed axial disc(s) and the gearwheels of the gear pump, and friction and wear are reduced.

One embodiment provides at least one and preferably several grooves as the surface structure on the inside of the axial disc. Advantageously the at least one groove runs in a circumferential direction and in addition has a component in the radial direction, so that a rotation of the gearwheels of the gear pump conveys fluid through the groove, which deflects the fluid towards the outside or inside so that the fluid passes between the gearwheels and the axial disc and wets the faces of the gearwheels substantially over their entire radial height.

In another embodiment, the at least one groove leads from the pump chamber of the gear pump between the axial disc and a gearwheel of the gear pump. Preferably at least one second groove leads from the pump chamber between the axial disc and the other gearwheel of the gear pump. Multiple grooves can be provided for each gearwheel of the gear pump.

An embodiment of the disclosure provides a rough surface on the inside of the axial disc. The rough surface can be produced by laser machining, erosion, honing, grinding, abrasive blasting—for example (steel) ball blasting—cold forming or similar surface treatment methods. The list is not conclusive. Another possibility of a rough surface according to the disclosure is a surface coating, for example a metal coating which is deposited chemically on the inside of the axial disc and receives a rough, for example bumpy, surface structure by means of a special current profile. Another possibility is a so-called DLC (diamond-like coating) i.e. a coating with anamorphous carbon which has good dry lubrication properties. This list too is not conclusive. The rough surface of the inside of the axial disc can act in a similar fashion to the grooves explained above, such that it causes or improves the conveyance of fluid by the rotating gearwheels of the gear pump between the faces of the gearwheels and the inside of the axial disc, and the distribution of the fluid over the faces of the gearwheels, and/or the rough surface can serve for adhesion of the fluid on the inside of the axial disc in order to retain a lubricant film between the inside of the axial disc and the faces of the gearwheels. The latter in particular counters a dry or mixed friction on start-up of the gear pump after a stoppage.

A rough surface is not necessary over the entire area of the inside of the axial disc; it is sufficient to have a rough surface in the region in which the axial disc lies against the faces of the gearwheels of the gear pump.

In another embodiment, the axial disc has a pressure field on its outside.

Yet another embodiment provides a gear pump with an axial disc of the type described above against a face of the gearwheels of the gear pump, preferably the gear pump has axial discs on both sides of its gearwheels. In one embodiment, an internal gear pump has one or preferably two such axial discs.

The gear pump according to the disclosure is proposed in particular as a hydropump for a hydraulic, slip-controlled and/or external-force vehicle braking system. Such hydropumps are often, although not necessarily, known as return pumps. A further use of the gear pump according to the disclosure is in common-rail fuel-injection systems for combustion engines, in particular as a pre-delivery pump.

BRIEF DESCRIPTION OF THE DRAWINGS

The disclosure is now explained below with reference to the drawings showing an exemplary embodiment. The drawings show.

DETAILED DESCRIPTION

Figure 1:
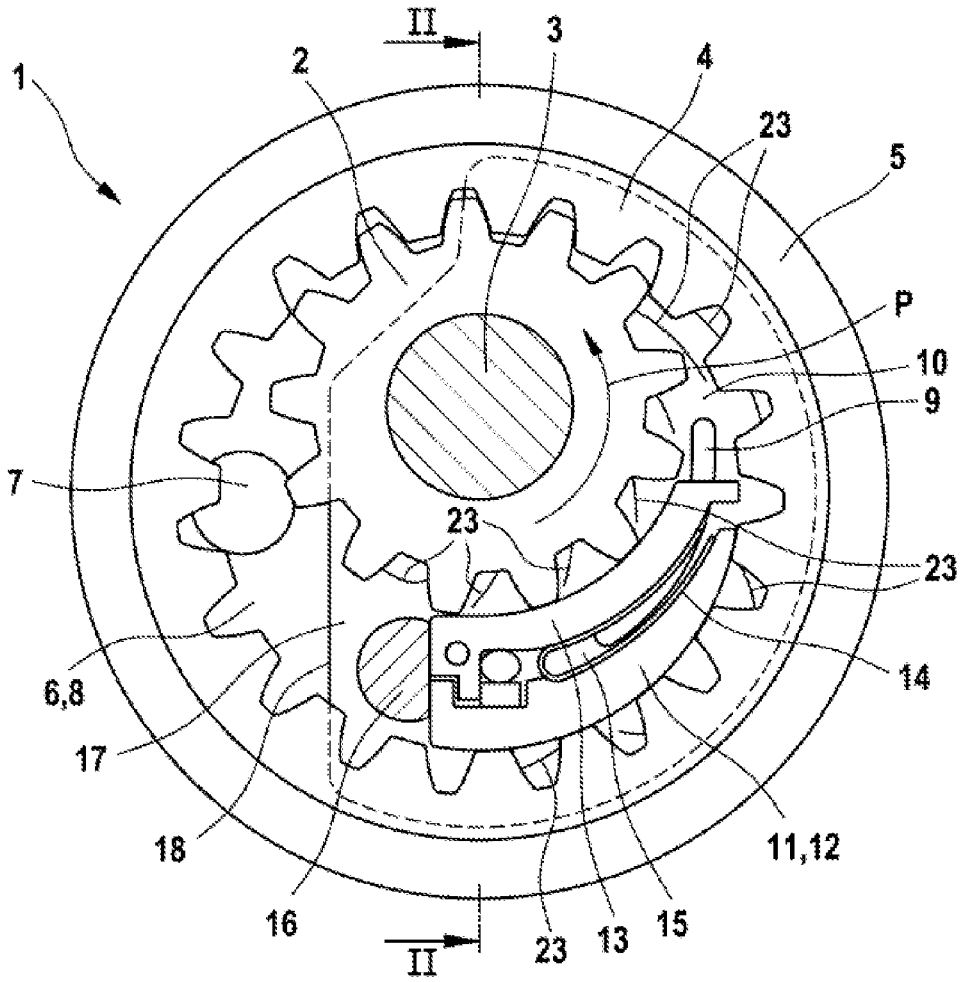
FIG. 1 an internal gear pump according to the disclosure in a front view without housing.
Figure 2:
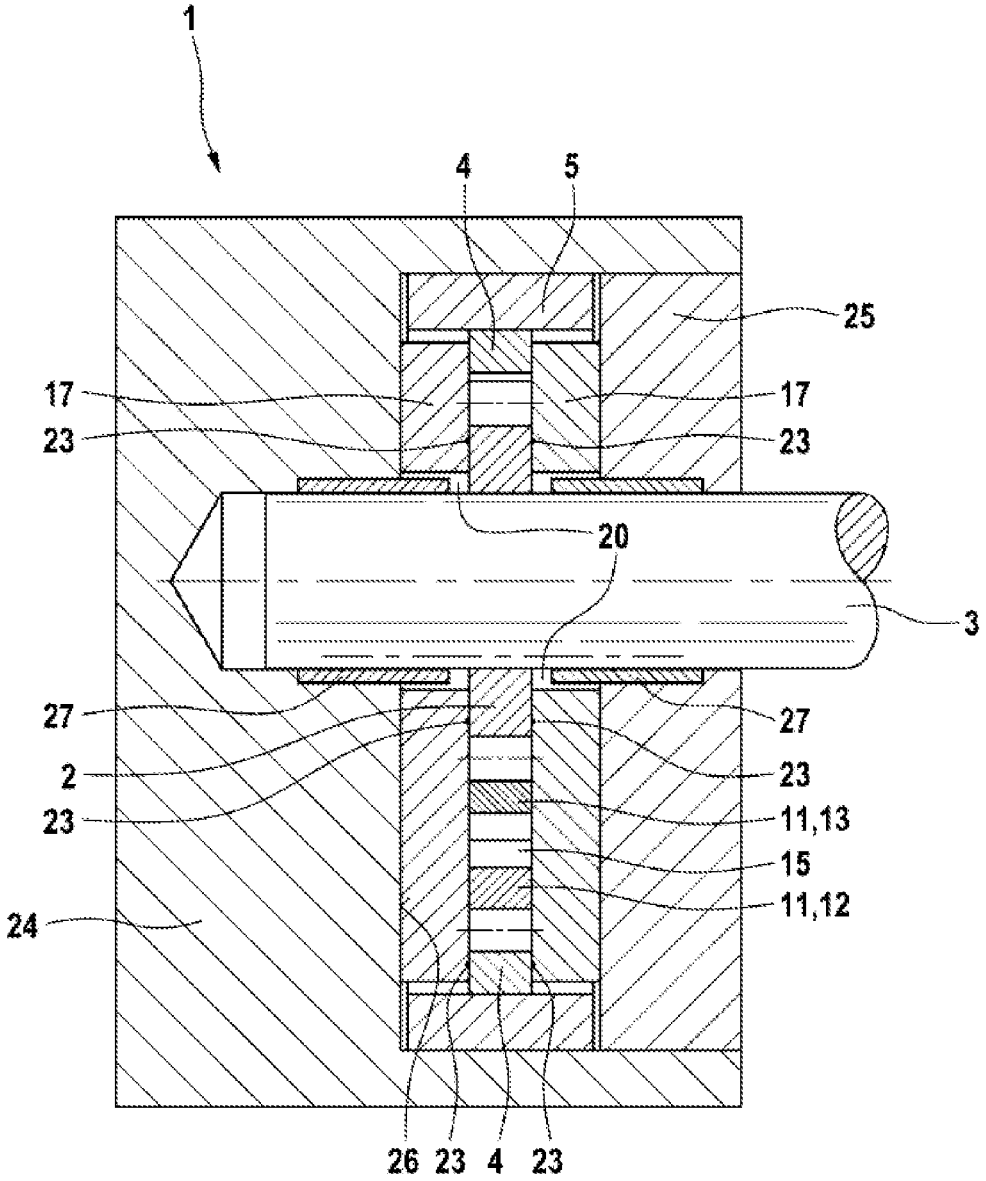
FIG. 2 an axial section of the internal gear pump from FIG. 1 along line II-II in FIG. 1.

The internal gear pump 1 according to the disclosure, shown in FIGS. 1 and 2, has an externally toothed gearwheel, designated below the pinion 2, which is rotationally fixed on a pump shaft 3. The pinion 2 is arranged in an internally toothed crown wheel 4 which is slip-mounted rotatably in a bearing ring 5. The pinion 2 and the crown wheel 4, which together are also designated the gearwheels 2, 4, have the same width and have rotary axes parallel to each other but offset so that they intermesh together on a peripheral portion. The pinion 2 is driven in rotation by the rotary drive of the pump shaft 3 and in turn drives the crown wheel 4 in rotation in the bearing ring 5. Outside the peripheral portion in which the two gearwheels 2, 4 intermesh, they delimit a sickle-shaped pump chamber 6 which extends in the circumferential direction.

Close to an end of one side, an inlet bore 7 opens into the pump chamber 6 and defines a suction region 8 of the pump chamber 6. Offset in the circumferential direction, an arcuate slot 9 opens into the pump chamber 6 and extends to near the other end of the sickle-shaped pump chamber 6. The slot 9 is part of a pump outlet and defines a pressure region 10 of the pump chamber 6.

A sickle-shaped body, referred to below as the sickle 11, is arranged in the pump chamber 6 between the pinion 2 and the crown wheel 4, and separates the suction region 8 from the pressure region 10. In the embodiment example shown, the sickle 11 is in two parts; it has a sickle-shaped outer part 12, on the outside of which the tooth heads of the teeth of the crown wheel 4 lie and slide along this on operation of the internal gear pump 1, and a sickle-shaped inner part 13, on the inside of which the tooth heads of the teeth of the pinion 2 lie and slide along this on operation of the internal gear pump 1. On their ends on the suction region side, the outer part 12 and the inner part 13 of the sickle 11 are joined together by a pivot, a leg spring 14 arranged between the outer part 12 and the inner part 13 presses the outer part 12 outward and the inner part 13 inward against the tooth heads of the teeth of the gearwheels 2, 4. In addition an internal chamber 15 between the outer part 12 and the inner part 13 of the sickle 11 is open towards the pressure region 10, so that the outer part 12 and inner part 13 are pushed apart under pressure and pressed against the tooth heads of the teeth of the gearwheels 2, 3 in order to achieve a good seal effect at the tooth heads of the teeth of the gearwheels 2, 4. At the end on the suction region side, the outer part 12 and the inner part 13 rest on a bolt 16 which passes transversely through the pump chamber 6 i.e. axially parallel to the gearwheels 2, 4. Fluid volumes are enclosed in the space widths of the teeth of the pinion 2 and crown wheel 4, and on rotational drive of the gearwheels 2, 4 in the direction of arrow P, convey fluid from the suction region 8 to the pressure region 10.

Figure 3:
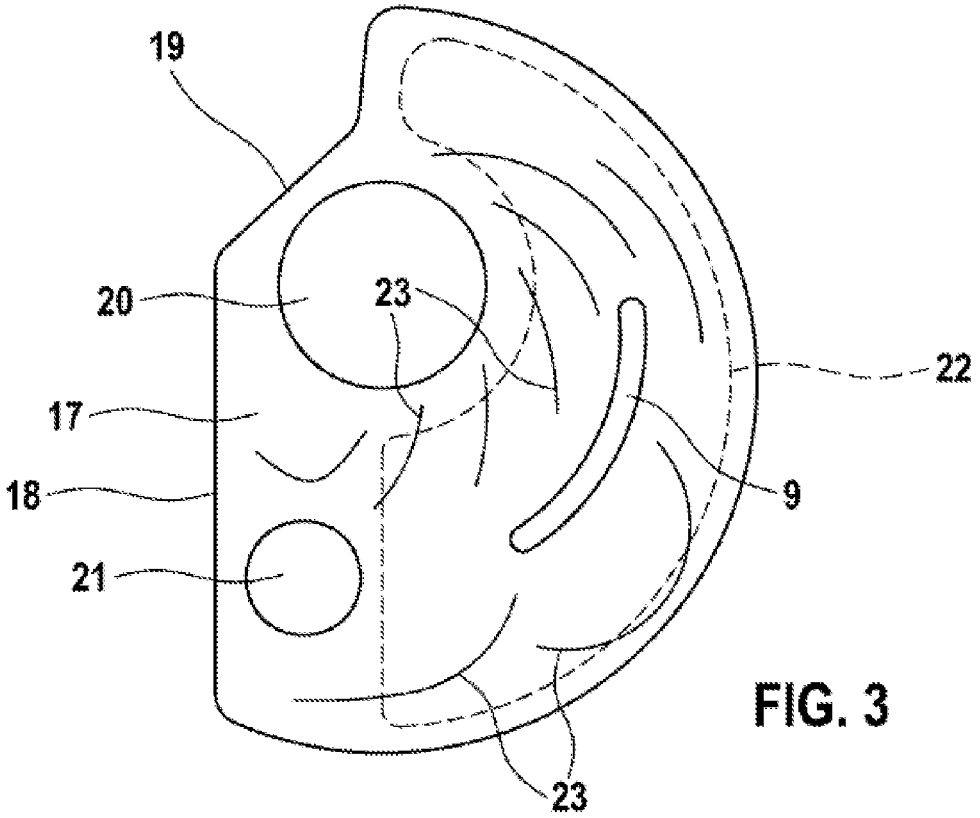
FIG. 3 a view of an inside of an axial disc of the internal gear pumps from FIGS. 1 and 2 according to the disclosure.

Plate-like bodies, here designated axial discs 17, which delimit the pump chamber 6 at the sides, lie against the faces of the gearwheels 2, 4. FIG. 3 shows an inside of one of the two axial discs 17, wherein the inside means the surface facing the gearwheels 2, 4 and lying against the faces of the gearwheels 2, 4. The axial discs 17 are formed as arc segments which extend over the pump shaft 3 and take up more than a semi-circle area. A radius of the axial discs 17 is slightly smaller than a radius of the crown wheel 4, but the axial discs 17 are sufficiently large that they cover the space widths between the teeth of the crown wheel 4 towards the outside up to beyond the tooth base. At one end of an edge 18 running in the chord direction, the axial discs 17 have a recess in the form of an oblique step 19.

The axial discs 17 have a hole 20 for the passage of the pump shaft 3 and a hole 21 for the passage of the bolt 16 close to the edge 18 running in the chord direction. The axial discs 17 cover the pressure region 10 of the pump chamber 6 completely, their edge running in the chord direction 18 lies in suction region 8 of the pump chamber 6. Insofar as a circumferential edge of the axial discs 17 in FIG. 1 is covered by the gearwheels 2, 4, it is indicated by a dotted line.

On their outsides facing away from the gearwheels 2, 4, the axial discs 17 each have a pressure field 22 which is drawn in dotted lines in FIG. 3. The pressure field 22 is a sickle-shaped, flat recess in the outside of the axial discs 17 which extends over the pressure region 10 of the pump chamber 6 and part of the sickle 11. The pressure field 22 communicates with the pressure region 10 through the arcuate slot 9 which passes through the axial disc 17 and lies within the pressure field 22, so that the axial discs 17 are pressurized on their outsides and pressed against the faces of the gearwheels 2, 4 in order to achieve a good seal there.

The insides of the axial discs 17 have a number of grooves 23 which run in an arc (not necessarily in the form of a circle arc) in the circumferential direction and have a radial component. Grooves 23 are located in the region of the crown wheel 4 and in the region of the pinion 2. The grooves 23 are formed such that they lead from the pump chamber 6, or the space widths between the teeth of the gearwheels 2, 4, between the gearwheels 2, 4 and the axial disc 17. On rotational operation, the gearwheels 2, 4 cause fluid to flow through the grooves 23 between the faces of the gearwheels 2, 4 and the axial discs 17, ensuring good lubrication between the rotationally fixed axial discs 17, which are pressed against the gearwheels 2, 4 by pressurization from the outside, and the gearwheels 2, 4.

The internal gear pump 1 is accommodated in a cylindrical depression of a pump housing 24 which is closed with a circular disc-shaped housing cover 25. The bearing ring 5 of the crown wheel 4 is pressed into the depression in the pump housing 24, the one axial disc 17 lies against a base 26 of the depression of the pump housing 24. The other axial disc 17 lies against the housing cover 25, the pressure fields 22 (not shown in FIG. 2) of the axial discs 17 are located between the axial discs 17 and the base 26 of the depression in the pump housing 24 or the housing cover 25. The internal gear pump 1 for conveying brake fluid is provided in a hydraulic vehicle brake system (not shown), the pump housing 24 can be part of a so-called hydraulic block in which hydraulic components (not shown) such as solenoid valves of a slip-control of the vehicle brake system are accommodated and connected together hydraulically. The pump shaft 3 is slipmounted with bearing bushes 27 in the pump housing 24 and in the housing cover 25.

Figure 4:
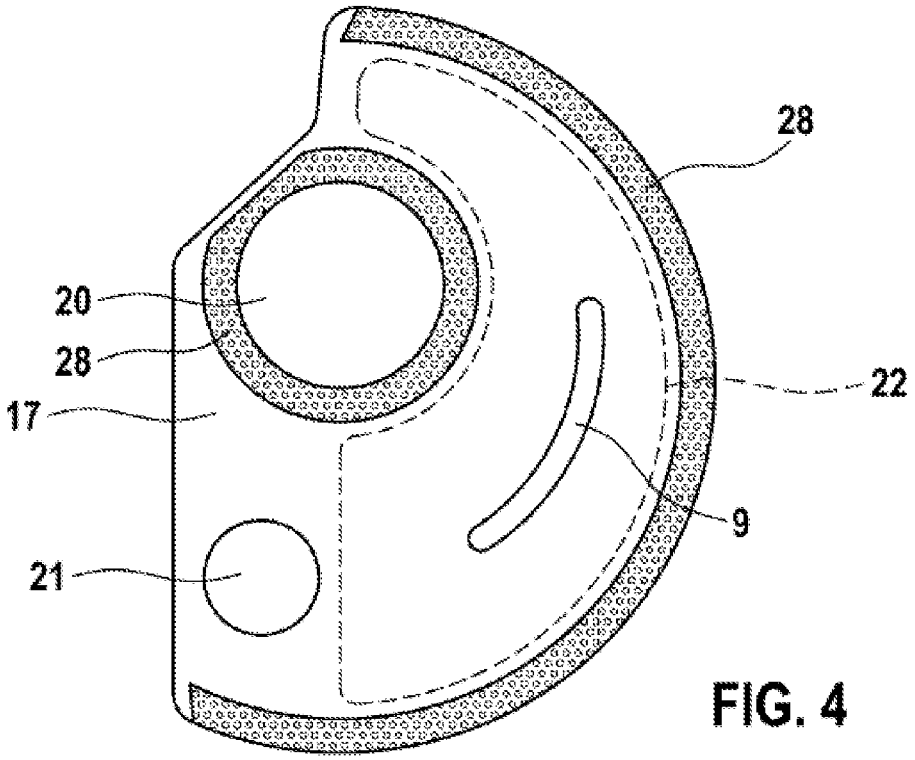
FIG. 4 a derived embodiment of an axial disc according to the disclosure for the internal gear pump from FIGS. 1 and 2, in a depiction corresponding to FIG. 3.

FIG. 4 shows a derived embodiment of the axial disc 17 of the internal gear pump 1. Instead of the grooves 23, the inside of the axial disc 17 from FIG. 4 which faces the gearwheels 2, 4 of the internal gear pump 1 and lies against the faces of the gearwheels 2, 4, has rough surfaces 28. In the embodiment example shown, the rough surfaces 28 are restricted to an annular region which surrounds the hole 20 for passage of the pump shaft 3 and to an arcuate region on the outer periphery of the circle segment-like axial disc 17. In other words the rough surfaces 28 lie in the region of the gearwheels 2, 4 of the internal gear pump 1. The rough surfaces 28 improve lubrication between the axial discs 17, lying against the faces of the gearwheels 2, 4, and the gearwheels 2, 4 of the internal gear pump 1. The lubrication effect is presumably attributable to the fact that the fluid conveyed by the internal gear pump adheres to the rough surfaces 28. The lubrication effect can also be due to the rough surfaces 28 forming channels on the insides of the axial discs 17, through which the gearwheels 2, 4 of the internal gear pump 1 convey the fluid required by the internal gear pump 1 for rotational operation, so that the fluid passes between the axial discs 17 and the faces of the gearwheels 2, 4.

The rough surfaces 28 can be produced by laser machining, erosion, cold forming, honing, grinding, abrasive blasting or similar surface treatment methods. Also the rough surfaces 28 can be achieved by coatings, for example by electrochemical deposition of metals, wherein a special current profile is selected for deposition which creates the rough surface 28. For example the current profile on deposition of the metal onto the inside of the axial discs 17 creates a bumpy coating i.e. a deposition in the form of microscopic spheres of the same or different sizes and distributed evenly or unevenly over the surface. Another possibility is so called DLC (diamond-like coating) i.e. coating of the insides of the axial discs 17 with amorphous carbon. The carbon has a good dry lubrication property. It is also porous and stores the fluid conveyed with the internal gear pump 1 as lubricant.

Otherwise the axial disc 17 from FIG. 4 is formed in the same way as the axial disc 17 from FIG. 3. To avoid repetition, for the explanation for FIG. 4, reference is also made to the statements relating to FIG. 3, wherein the same elements carry the same reference numerals in FIG. 3 and in FIG. 4.

The invention claimed is:

1. An axial disc for a gear pump, comprising:

a surface structure on an inside of the axial disc facing gearwheels of the gear pump, wherein the surface structure conducts fluid conveyed by the gear pump between the gearwheels and the axial disc, wherein the surface structure includes a rough surface on the inside of the axial disc, and wherein the inside of the axial disc has the rough surface in a region in which the axial disc contacts at least one of the gearwheels of the gear pump.

2. The axial disc as claimed in claim 1, wherein the rough surface on the inside of the axial disc includes an abrasive-blasted surface.

3. The axial disc as claimed in claim 1, wherein the rough surface on the inside of the axial disc includes a rough surface coating.

4. An axial disc for a gear pump, comprising:

a surface structure on an inside of the axial disc facing gearwheels of the gear pump, wherein the surface structure includes at least one of a groove and a rough surface configured to conduct fluid conveyed by the gear pump between the gearwheels and the axial disc, and wherein the axial disc has an outside, and a pressure field is defined on the outside.

5. A gear pump comprising:

two intermeshing gearwheels; and an axial disc supported on one side of the gearwheels, wherein the gear pump is pressurized at an outside of the axial disc, facing away from the gearwheels, so that the axial disc is pressed against the gearwheels, wherein, on an inside facing the gearwheels, the axial disc has a surface structure configured to conduct fluid conveyed by the gear pump between the gearwheels and the axial disc, wherein the surface structure includes a rough surface on the inside of the axial disc, and wherein the inside of the axial disc has the rough surface in a region in which the axial disc contacts at least one of the gearwheels of the gear pump.

6. The gear pump as claimed in claim 5, wherein the gear pump is an internal gear pump.

* * * * *